US005548184A

United States Patent [19]

Choi et al.

[11] Patent Number: 5,548,184

[45] Date of Patent: Aug. 20, 1996

[54] OXIDE CATHODE EMPLOYING BA EVAPORATION RESTRAINING LAYER

[75] Inventors: Kwi-seok Choi, Seoul; Jong-seo Choi, Anyang; Kyung-cheon Shon, Suwon; Gyu-nam Ju, Seoul; Sang-won Lee, Kunpo, all of Rep. of Korea

[73] Assignee: Samsung Display Devices Co., Ltd., Kyungki-do, Rep. of Korea

[21] Appl. No.: 511,838

[22] Filed: Aug. 7, 1995

Related U.S. Application Data

[63] Continuation of Ser. No. 164,552, Dec. 10, 1993, abandoned.

[30] Foreign Application Priority Data

Aug. 23, 1993 [KR] Rep. of Korea ..... 93-16347

[51] Int. Cl.[6] ..... H01J 1/14; H01J 19/06

[52] U.S. Cl. ..... 313/346 R; 313/346 DC; 252/521

[58] Field of Search ..... 313/346 R, 346 DC; 252/520, 521; H01J 1/14, 19/06

[56] References Cited

U.S. PATENT DOCUMENTS

| | | | |
|---|---|---|---|
| 3,454,816 | 7/1969 | Hoffmann et al. | 313/346 |
| 4,483,785 | 11/1984 | Johnson et al. | 252/520 |
| 4,797,593 | 1/1989 | Saito | 313/346 R |
| 4,924,137 | 5/1990 | Watanabe et al. | 313/337 |
| 5,126,623 | 6/1992 | Choi | 313/346 DC |

*Primary Examiner*—Wendy Garber
*Assistant Examiner*—Ngoc-Yen Vu
*Attorney, Agent, or Firm*—Leydig, Voit & Mayer

[57] ABSTRACT

An oxide cathode is provided including a metal base, an electron emissive material layer formed on the metal base and having barium as a main component, a heater for heating the electron emissive material layer, and a Ba evaporation restraining layer having a thickness ranging from 10Å to 10,000Å and consisting of at least one titanium compound formed on the electron emissive material layer.

10 Claims, 1 Drawing Sheet

OXIDE CATHODE EMPLOYING BA EVAPORATION RESTRAINING LAYER

This application is a continuation of U.S. patent application Ser. No. 08/164,552, filed Dec. 10, 1993, now abandoned.

BACKGROUND OF THE INVENTION

The present invention relates to an oxide cathode for an electron tube such as a cathode ray tube, and more particularly, to a novel oxide cathode having an improved electron emission characteristic and long lifetime.

As a conventional thermoelectron emissive cathode for an electron gun of an electron tube, an oxide cathode having a carbonate of an alkaline earth metal on a metal base of which the major component is Ni is widely used. The cathode is called an "oxide cathode" because the carbonate of the alkaline earth metal changes to an oxide during the process for manufacturing an electron tube.

The oxide cathode has the advantage of operating at relatively low temperature (700°~800° C.) since it has a low work function. On the other hand, when electron emission density increases, raw material evaporates or melts by self-heating due to Joule heat because the material is a semiconductor and has high electrical conductance, which thus deteriorates the cathode. Moreover, an interlayer is/brined between the metal base and the oxide layer due to prolonged operation, which shortens cathode lifetime.

FIG. 1 illustrates a cross-sectional view of a conventional oxide cathode. The general oxide cathode is provided with a disk-type metal base 2, a cylindrical sleeve 3 which supports the metal base 2, a heater 4 placed in the sleeve for heating the cathode, and an electron emissive material layer 1 which contains alkaline earth metal oxide as a main component and is coated and formed on the metal base 2. That is, the oxide cathode is manufactured by closing one end of a hollow cylindrical sleeve 3 with a metal base 2, inserting a heater 4 in the sleeve 3 for heating the cathode, and forming an electron emissive material layer 1 of a mixture of at least two alkaline earth metal compounds on the surface of the metal base 2.

Among the elements, the metal base provided on the sleeve supports the electron emissive material layer. The metal base uses heat-resistant metal materials such as platinum, nickel, etc. and is made of an alloy containing at least one reducing agent to help reduction of the alkaline earth metal oxide layer formed on the surface thereof. As for the reducing agent, reducible metals such as W, Mg, Si, Zr, etc. are usually employed, and the amount added varies according to their reducibility. More than two can be simultaneously employed to improve the cathode characteristics.

The sleeve supports the metal base and holds the heater therein. Heat-resistant metals such as molybdenum, tantalum, tungsten, stainless steel, etc. are selected for the raw materials of the sleeve considering thermal characteristics such as heat conductance.

The heater is provided in the sleeve to heat the electron emissive material layer coated on the metal base to emit thermo-electrons through the metal base. The heater is made by coating metal wire such as tungsten with alumina to form an electrically insulative layer.

The electron emissive material layer which emits thermoelectrons is formed on the surface of the metal base and is usually made of an alkaline earth metal (Ba, Sr, Ca, etc.) oxide layer. The oxide layer is manufactured by coating a dispersion of alkaline earth metal carbonate on the metal base and heating under vacuum using the heater to change the carbonate to all alkaline earth metal oxide. The layer is partially reduced at a high temperature of 900°~1000° C. to activate the alkaline earth metal oxide to impart the characteristics of a semiconductor.

As the alkaline earth metal oxide, BaO mixed with SrO and/or CaO gives better electron emission characteristics than the single oxide of BaO. The reason is generally regarded as follows. That is, Sr and Ca are classified in the same family with Ba in the Periodic Table, and Sr and Ca become the same divalent cation as Ba ions and occupy the spaces where Ba ions had been. At this time, the immediately surrounding environment is somewhat disturbed since the atomic radius of Sr or Ca is different from that of Ba, which endows the oxygen ions with a high electric potential and thus makes them unstable. This is easily activated during reduction under a high temperature treatment and results in an advantageous aging.

The reducing agents, such as Si, Mg, etc., contained in the metal base diffuses during the activation process and thereby move toward an interface of the electron emissive material layer of alkaline earth metal oxide with the metal base, and reacts with the alkaline earth metal oxide as the following reaction. The barium oxide contained the electron emissive material layer is reduced through the reaction with the reducing agent, such as Mg, Si, etc., in the metal base to produce free barium. The free barium is the source of the electron emission.

$$BaO+Mg \rightarrow MgO+Ba\uparrow$$

$$4BaO+Si \rightarrow Ba_2SiO_4+2Ba\uparrow$$

As described above, free barium from BaO plays the role of all oxygen-deficient semiconductor and, ultimately, emission current of 0.5~0.8A/cm at the operation temperature of 700°~800° C. is obtainable.

However, generally since the operation temperature of the oxide cathode is so high (about 750° C. or more), Ba, St, Ca, etc. are evaporated due to the vaporization pressure and the electron emission capacity decreases over operating time.

Meanwhile, as shown in the reaction equations, during free barium production, the reducing agents in the metal base also oxidize to produce oxides such as MgO, $Ba_2SiO_4$, etc. These kinds of metal oxides are electrically insulative and accumulate to form an interlayer at the interface of electron emissive material layer with metal base, which acts as a barrier. The thus-formed barrier produces joule heat which increases the operating temperature. This also interrupts the diffusion of the reducing agents such as Mg, Si, etc. and suppresses the production of free barium. Moreover, the interlayer disturbs the replenishment of the evaporated Ba, Sr or Ca and results in the shortening of the cathode lifetime. Since the interlayer has high resistance, the flow of the electron emissive current is interrupted.

That is to say, tier the conventional oxide cathode, free Ba is continuously produced at the thermoelectron emission temperature, which enables electron emission accompanying partial evaporation of the free Ba. If a large amount of free Ba evaporates and is consumed, the electron emission function of the cathode deteriorates abruptly, and the cathode operation ends immediately.

Among the various factors which determine the lifetime of a cathode, the reduction of the barium content accompanied by the cathode operation and the interlayer growth as described above are important factors. Hence, research for improving the cathode lifetime as well as electron emission capability by changing electron emissive material components or including specific compounds therein has been carried out.

U.S. Pat. No. 4,797,593 discloses a technique on all improvement of the electron emission characteristic and cathode lifetime by including rare earth metal oxides in an electron emissive material layer.

Since the oxide cathode can be advantageously manufactured and has good characteristics, much investigation into the oxide cathode is being carried out and the oxide cathode is widely used as an electron emission source. However, recently as large and fine electron tubes are required a cathode for an electron tube having enhanced characteristics of electron emission and a longer lifetime is needed. Accordingly, the conventional oxide cathode needs further improvements since they do not meet the requirements owing to the above-mentioned various problems.

SUMMARY OF THE INVENTION

The present invention is accomplished by considering the above-mentioned characteristics and problems of the conventional oxide cathode. Thus, the object of the present invention is to provide all oxide cathode having improved electron emission characteristics and lifetime characteristics not by including additional materials in the electron emissive material layer, but by forming a thin layer on the electron emissive material layer and restraining the free Ba evaporation.

To accomplish the object, there is provided all oxide cathode comprising a metal base, an electron emissive material layer formed on the metal base and including barium as a main component, and a heater for heating the electron emissive material layer, characterized in that a Ba evaporation restraining layer comprising titanium is formed on the electron emissive material layer.

BRIEF DESCRIPTION OF THE DRAWINGS

The above object and advantages of the present invention will become more apparent by describing in detail a preferred embodiment thereof with reference to the attached drawings, in which.

DETAILED DESCRIPTION OF THE INVENTION

The oxide cathode of the present invention has a prolonged lifetime by restraining Ba evaporation during cathode operation through forming a thin layer containing titanium on the electron emissive material layer.

Figure 1:
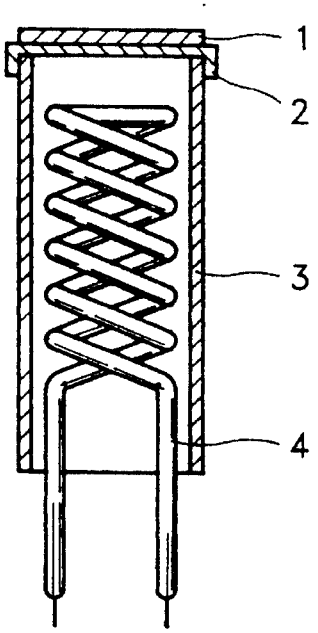
FIG.1(PRIOR ART)
FIG. 1 is a cross-sectional view of a conventional oxide cathode.
Figure 2:
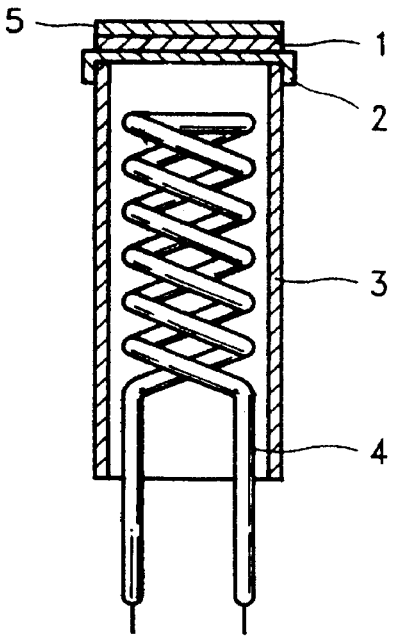
FIG. 2 is a cross-sectional view of an oxide cathode according to the present invention.

FIG. 2 is a cross-sectional view of the oxide cathode according to the present invention. When comparing with the conventional oxide cathode illustrated in FIG. 1, it is noted that Ba evaporation restraining layer 5 is formed on the electron emissive material layer 1. Though the Ba evaporation restraining layer 5 lengthens the cathode lifetime by restraining Ba evaporation, the layer should be formed so as to minimize the side effects to the electron emissive function of Ba.

The Ba evaporation restraining layer is manufactured by including a titanium-containing compound, preferably at least one selected from the group consisting of $CaTiO_3$ and $SrTiO_3$. Also, the preferred thickness of the Ba evaporation restraining layer ranges from 10Å to 10,000Å. If the thickness of the layer is thinner than 10Å the effect of restraining Ba evaporation is too weak, and if thicker than 10,000Å the amount of the electron emission is reduced owing to the side effects to the electron emission and thus decreases the improvement of the electron emission characteristic. Accordingly, the above-mentioned thickness range of the Ba evaporation restraining layer is preferable.

As the electron emissive material, tri-carbonate such as (Ba. Sr,Ca)$CO_3$ or di-carbonate such as (Ba,Sr)$CO_3$ could be employed. At this time, the tri-carbonate is generally prepared by dissolving nitrates such as $Ba(NO_3)_2$, $Sr(NO_3)_2$ and $Ca(NO_3)_2$ in distilled water and then coprecipitating them into carbonate by adding a precipitating agent such as $Na_2CO_3$, $(NH_4)_2CO_3$, etc. The thus-obtained coprecipitated tri-carbonate is applied on the metal base through dipping, spray, sputtering or electro-deposition.

Next, the Ba evaporation restraining layer is formed on the thus-manufactured carbonate coating layer, for example, by an rf sputtering method with $CaTiO_3$ and/or $SrTiO_3$ at a thickness of 10Å to 10,000Å. The method for manufacturing the thin layer is not specially limited.

The thus-manufactured cathode is inserted and fixed in an electron gun and a heater for heating the cathode is inserted and fixed in a sleeve. The electron gun is sealed in a bulb for an electron tube. The carbonate of the electron emissive material layer is decomposed to an oxide by the heater for heating the cathode, in a vacuum during an exhausting process, and then activating the oxide to produce free barium so that it can emit electrons, according to the common method for manufacturing electron tube.

The preferred embodiment of the present invention will be described detail below. The examples are for illustrating the present invention which is not limited to these.

EXAMPLE 1

To a mixture solution of $Ba(NO_3)_2$, $Sr(NO_3)_2$ and $Ca(NO_3)_2$ at a mixing ratio of Ba:Sr:Ca being 50:40:10, $Na_2CO_3$ was added to prepare a coprecipitated carbonate of Ba, SF and Ca.

The carbonate was dispersed in an organic solvent to prepare a dispersion, coated on the Ni metal base containing Si and Mg by a spray method and then dried to prepare a coating layer.

Next, the Ba evaporation restraining layer was formed on the coating layer by coating $CaTiO_3$ to a thickness of 50Å by a rf sputtering procedure.

EXAMPLE 2

The procedure was carried out in a same manner described in Example 1 except that $SrTiO_3$ was used and the thickness of the formed $SrTiO_3$ was 5,000Å.

To examine the lifetime characteristics of the oxide cathode having Ba evaporation restraining layer formed on the electron emissive material layer, the thus-formed cathode is inserted and fixed in an electron gun. Then, a heater for heating cathode is inserted and fixed in a sleeve. The manufactured electron gun is sealed in a bulb for an electron tube and the inner-side of the bulb is exhausted to vacuum through an exhaustion process, while heating the electron emissive material layer with a heater to change the carbonate into oxide by thermolysis. Then, the cathode is activated using the same process of the conventional method for manufacturing an electron tube and the electron emission characteristic of the cathode is detected.

The electron emission characteristics are determined as a maximum cathode current (MIK) which is the maximum current that the cathode emits under specific conditions, and the lifetime characteristic of the cathode is evaluated as a MIK-maintaining degree over a given period. The lifetime characteristic of the oxide cathode of the present invention is determined and evaluated by operating the equipped cathode for a certain time while detecting the decrease in electron emission current.

Figure 3:
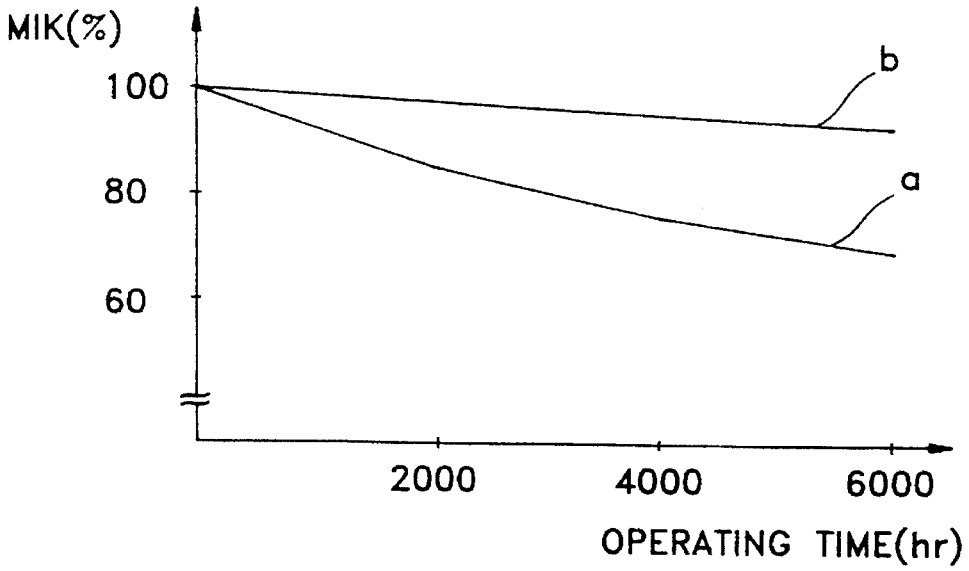
FIG. 3 illustrates a graph showing MIK variation with respect to the operating time of the conventional oxide cathode and an oxide cathode of the present invention, in which plot "a" is for a conventional oxide cathode and plot "b" is for an oxide cathode of the present invention.

FIG. 3 illustrates a graph showing MIK variation as relative values (%) with respect to the operating time of the conventional oxide cathode and an oxide cathode of the present invention, in which plot "a" corresponds to a conventional oxide cathode and plot "b" corresponds to an oxide cathode manufactured in Example 1 of the present invention.

From FIG. 3, it is confirmed that the oxide cathode of the present invention has an effect of improved lifetime by about 20% or more, over that of the conventional oxide cathode.

In conclusion, the oxide cathode having a titanium containing layer formed on the electron emissive material layer according to the present invention has improved electron emission characteristics and longer lifetime when compared with the conventional oxide cathode.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. An oxide cathode comprising a metal base, an electron emissive material layer formed on said metal base and including barium as a main component, a heater for heating said electron emissive material layer, and a Ba evaporation restraining layer having a thickness ranging from 10Å to 10,000Å and consisting of at least one titanium compound formed on said electron emissive material layer.

2. An oxide cathode as claimed in claim 1, wherein said titanium compound is $SrTiO_3$.

3. An oxide cathode as claimed in claim 1, wherein said titanium compound is $CaTiO_3$.

4. An oxide cathode as claimed in claim 1 wherein said at least one titanium compound consists of $CaTiO_3$ and $SrTiO_3$.

5. An oxide cathode as claimed in claim 1 wherein the thickness of said Ba evaporation restraining layer ranges from 50Å to 5,000Å.

6. An oxide cathode as claimed in claim 2 wherein the thickness of said Ba evaporation restraining layer ranges from 50Å to 5,000Å.

7. An oxide cathode as claimed in claim 3 wherein the thickness of said Ba evaporation restraining layer ranges from 50Å to 5,000Å.

8. An oxide cathode as claimed in claim 4 wherein the thickness of said Ba evaporation restraining layer ranges from 50Å to 5,000Å.

9. An oxide cathode as claimed in claim 1 wherein said electron emissive material layer comprises a coprecipitated carbonate of Ba, Ca and Sr.

10. An oxide cathode as claimed in claim 9 wherein the mixing ratio of Ba:Sr:Ca is 50:40:10.

* * * * *